United States Patent [19]

Ingram

[11] Patent Number: 4,545,312

[45] Date of Patent: Oct. 8, 1985

[54] TUFTING MACHINES

[75] Inventor: Gary L. Ingram, Ooltewah, Tenn.

[73] Assignee: Spencer Wright Industries, Inc., Chattanooga, Tenn.

[21] Appl. No.: 638,243

[22] Filed: Aug. 6, 1984

[51] Int. Cl.[4] ..... D05B 71/00

[52] U.S. Cl. ..... 112/256; 184/6.15; 184/6.18

[58] Field of Search ..... 112/79 R, 43, 256; 184/6.15, 6.18

[56] References Cited

U.S. PATENT DOCUMENTS

| | | | |
|---|---|---|---|
| 2,837,173 | 6/1958 | Ciecior | 184/6.15 |
| 3,060,877 | 10/1962 | Ketterer | 184/6.15 |
| 3,767,013 | 10/1973 | Caldwell | 184/6.18 |
| 3,773,003 | 11/1973 | Marforio | 112/256 |
| 3,981,257 | 9/1976 | Kelly | 184/6.15 |
| 4,419,948 | 12/1983 | von Hagen | 184/6.18 |

*Primary Examiner*—Ronald Feldbaum
*Attorney, Agent, or Firm*—Alan Ruderman

[57] ABSTRACT

A tufting machine having a plurality of reciprocating push rods journally mounted in respective push rod housings carried by the head of the machine includes a sleeve having a sealing arrangement for preventing leakage of lubricant past the push rod housing onto the fabric produced. In one form the sleeve has a seal at the bottom, a circumferential groove disposed above the seal opening onto the push rod, and a pair of passageways communicating with the groove. Air may be blown through one passageway to pick up and carry oil from the groove back to the oil supply, or the two passageways may be connected to the inlet of an oil pump mounted in the head, or one passageway may be open to ambient while the other passageway includes a conduit which returns to the inlet of the pump. In the preferred form three seals are disposed within the sleeve vertically adjacent each other with the upper seal inverted relative to the lower two seals. A passageway enters the sleeve between each pair of seals and returns any oil to the inlet of the oil pump.

37 Claims, 6 Drawing Figures

TUFTING MACHINES

BACKGROUND OF THE INVENTION

This invention relates to tufting machines and more particularly to apparatus for reducing or eliminating oil leakage from the push rod housings of tufting machines especially those operating at very high speeds.

In a tufting machine a multiplicity of needles are reciprocably driven to penetrate a moving backing material to form loops of yarn beneath the backing material, the needles cooperating with loopers or hooks which seize the loops, and either release the loops or hold them until cut, thereby providing either loop or cut tufts protruding from the backing material. The needles are supported by a bar which is driven by a number of push rods journalled in push rod housings in the head of the machine and reciprocably driven by drive means carried in the head of the machine. To provide lubrication and cooling of the push rods and the drive means the frame of the machine includes an oil sump and pump means for directing lubricating oil onto the moving parts.

Sealing the reciprocating push rods in the housing against oil leakage from the push rod housings onto the tufted fabric has always been a problem in the tufting art. Consequently, a water soluble lubricant was developed and has been used for some time. Until relatively recently this lubricant was washed from the tufted fabric in carpet manufacturing facilities during the dying process which utilized a dying bath including detergents which acted to dissolve and wash the lubricant from the fabric during the dying operation. However, recently a more cost effective and energy efficient dying process using foam was developed and is now substantially universally used. Thus, any lubricant that leaks onto the fabric remains and the fabric must be discarded or sold as seconds.

In addition to the reemergence of lubricant leakage as a problem because of the change in dying process, recent tufting machines are operating at substantially higher speeds resulting in a greater leakage of lubricant from the push rod housings. The presently known seals have not been effective against prevention of leakage from the push rod housings. Most of the seals, if effective at all, are only effective for a few hundred thousand cycles. Since a tufting machine such as that illustrated in copending U.S. application Ser. No. 540,365 which is a continuation of application Ser. No. 407,753 operates at speeds in excess of 1200 rpm, the push rods undergo over a million and a half cycles in a 24 hour period resulting in rapid deterioration and failure of the seals and substantial leakage onto the fabric.

Additionally, as the speed of the tufting machine increases, and thus the speed at which the push rods are reciprocating increases, the frictional heat generated causes the push rods to become hot. Consequently, to reduce the heating of the push rods it is desired that additional lubricant be supplied to cool the push rods. This compounds the leakage problems since additional lubrication of the push rods has resulted in additional leakage from the push rod housings.

SUMMARY OF THE INVENTION

Consequently, it is a primary object of the present invention to provide in a tufting machine apparatus for eliminating or at least alleviating to a substantial degree lubricant leakage from the push rod housings.

It is another object of the present invention to provide in a tufting machine having a reciprocating push rod journalled in a push rod housing apparatus for drawing lubricant out of the push rod housing and returning the lubricant to the lubricant supply in the frame of the tufting machine.

It is a further object of the present invention to provide in a tufting machine having a plurality of push rods reciprocably journalled in respective push rod housings in the head of the machine, a seal disposed about each push rod, a lubricant accumulator above the seal opening onto the push rod for accumulating oil at a location before it reaches the seal, a conduit communicating with the accumulator, and means for creating a pressure differential between the accumulator and the lubricant supply for removing the lubricant from the accumulator and returning it through the conduit to the lubricant supply.

It is a still further object of the present invention to provide in a tufting machine having a plurality of push rods reciprocably journalled in respective push rod housings in the head of the machine, a plurality of seals disposed about each push rod, a lubricant accumulator disposed between each adjacent pair of seals for collecting lubricant before the lubricant reaches the seal furthest from the head, a conduit communicating with each accumulator, and means for creating a pressure differential between each accumulator and the lubricant supply for removing the lubricant from the respective accumulator and returning it through the respective conduit to the lubricant supply.

Accordingly, the present invention provides in a tufting machine having at least one push rod reciprocably journalled in a push rod housing carried by the head of the machine and lubricated by oil supplied from the head, apparatus for substantially minimizing leakage of oil from the push rod housing onto the fabric produced by the tufting machine. The apparatus includes at least one seal disposed about the push rod, a lubricant accumulator disposed between each pair of seals, or in the case of a single seal, between the seal and the head of the machine for collecting oil carried by the push rod before it reaches the seal furthest from the push rod housing, a conduit communicating each accumulator with the lubricant supply, and means for creating a pressure differential between each accumulator and the supply of lubricant for returning collected oil from the accumulator through the conduit to the lubricant supply.

In the preferred embodiments of the invention a sleeve or bushing is disposed about the push rod and secured to the lower end of the push rod housing, the sleeve supporting the seals and having the accumulators. In the preferred form of the invention the sleeve carries three annular seals through which each push rod reciprocates so that there are two lubricant accumulators, one between each adjacent pair of seals opening onto the push rod. A passageway communicates each push rod accumulator with a lubricant reservoir preferably communicating with the inlet of the tufting machine lubrication pump which draws the lubricant from each accumulator. It has been found that when the seal comprises an annular base having a resilient annular member secured to the inner diameter of the base, if the upper seal, i.e., the seal closest to the top dead center of the reciprocating push rod is inverted relative to the other two seals, unusual and suprising results occur such that the push rod housing does not leak and the amount of lubricant drawn from the lower accumulator is substantially nil.

In the other embodiments the sleeve has a recess at the lower end for receiving an annular seal and having an oil accumulator groove opening onto the push rod above the seal, the sleeve including a pair of passageways opening onto the accumulator groove and extending to the outer surface thereof. In one form air under pressure is directed into one of the passageways and carries the collected oil out of the other passageway to a conduit which returns the oil to the oil sump in the head of the machine. In another form both passageways are connected to conduits to which a vacuum is applied at the inlet of an oil pump, preferably the same pump which supplies the oil to the push rods. In yet another form one passageway is connected to a conduit which returns the oil to the inlet of the pump while the other passageway is open to ambient conditions and may have a needle valve to control the amount of air drawn in through the open passageway.

In each of the embodiments having the recess, the sleeve may include a second recess above the accumulator groove for receiving a second seal, thereby isolating the accumulator from the two seals. It has been found that this is especially effective when used with the form of the invention in which air is blown into one of the passageways to carry the oil back to the supply since it permits additional lubricant to be supplied to the push rods rather than tending to force oil back up along the surface of the push rods. Thus, not only is leakage inhibited, but more lubrication can be supplied to cool the push rods to lower temperatures.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
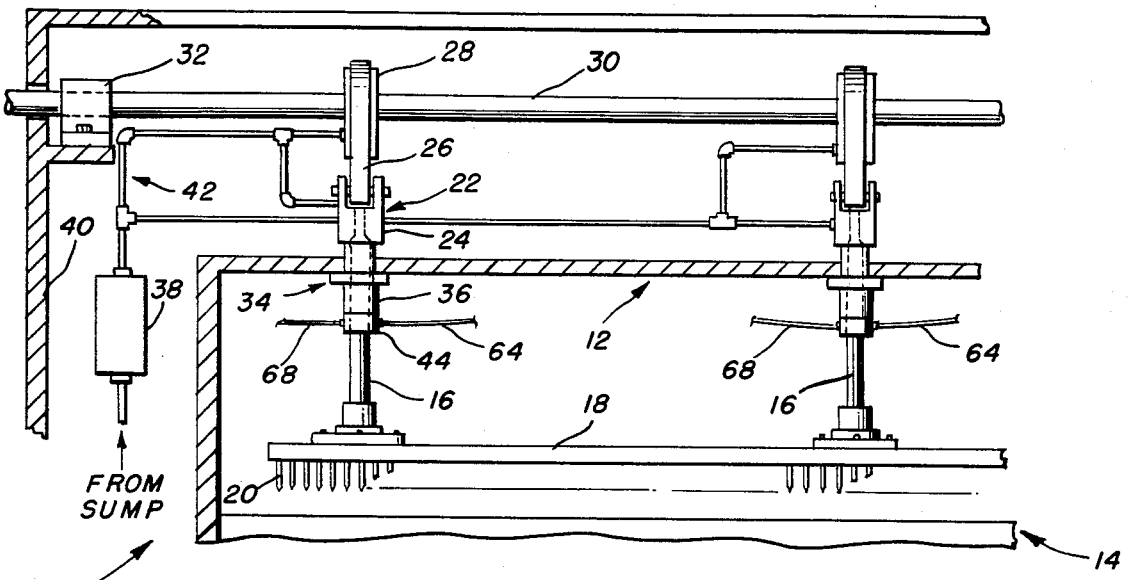
FIG. 1 is a fragmentary vertical cross-sectional view taken through a tufting machine incorporating the features of the present invention.

Referring now to FIG. 1, a portion of a tufting machine is illustrated at 10 having a frame comprising a head 12 and a bed 14 disposed below the head. Conventionally mounted in the head 12 for vertical reciprocation are two of a plurality of push rods 16 to the lower end of which a needle bar 18 is carried and which in turn carries a plurality of needles 20 which are adapted to penetrate a fabric (not illustrated) fed over the bed 14 upon reciprocation of the needle bar to project loops of yarn therethrough. Endwise reciprocation is imparted to the push rods 16 by linkage generally indicated at 22 which includes a yoke 24 pivotably connected to a pitman connecting rod 26 connected to a cam 28 eccentrically mounted on the main shaft 30 which is journally mounted in bearing blocks 32 in the head. Secured to the head 12 for journally guiding the push rod 16 is a respective push rod housing 34 including a collar 36.

Conventionally lubricant is sprayed or otherwise flows from a lubricant pump 38 mounted in the end housing 40 of the head 12 onto the rotating and reciprocating elements mounted in the head, the lubricant being pumped from a reservoir or sump in the end housing support legs and directed by the pump through conduits such as illustrated at 42. This lubricant contacts the upper portion of the push rods for lubricating and cooling purposes. However as the lubricant enters the collar 36 it tends to build up about a seal disposed about the push rod within the collar 36. Consequently, and especially in tufting machines operating at very high speeds as aforesaid, leakage of lubricant occurs from the bottom of the collar and, if excessive, results in defective fabric produced by the tufting machine.

Figure 3:
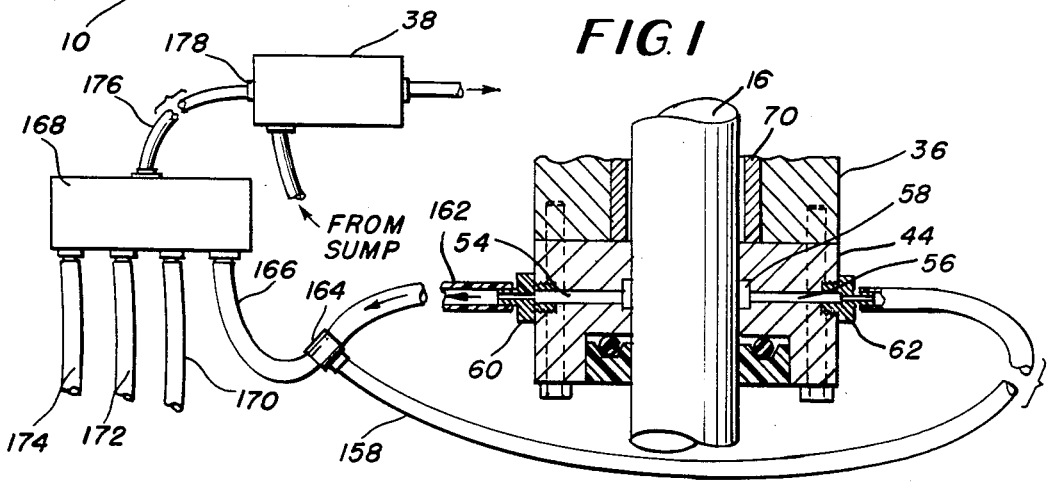
FIG. 3 is a view similar to FIG. 2 but illustrating another embodiment of the invention.
Figure 4:
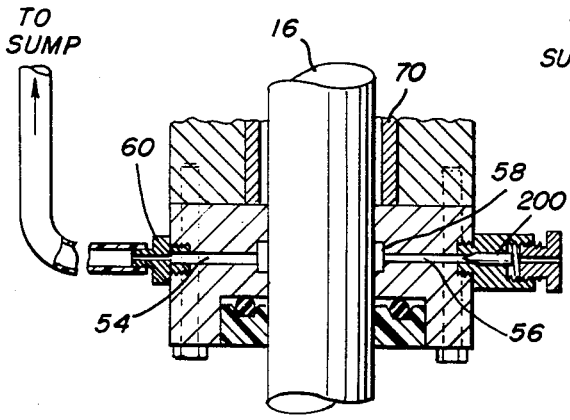
FIG. 4 is a view similar to FIG. 2 and illustrating another form of the invention.
Figure 2:
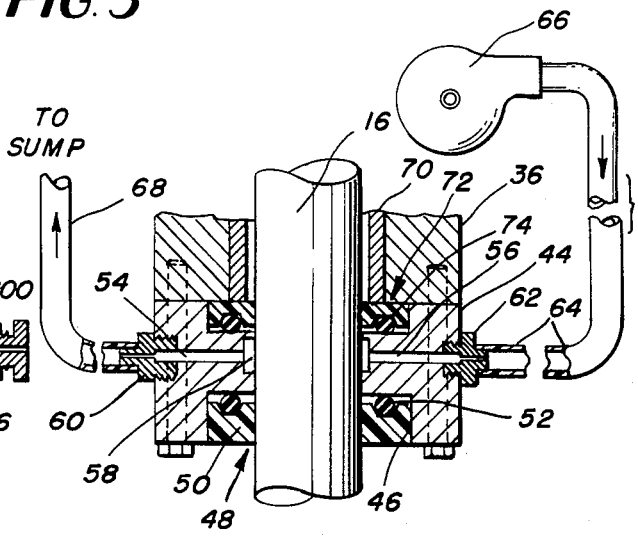
FIG. 2 is an enlarged cross-sectional view of a portion of the tufting machine illustrated in FIG. 1 constructed in accordance with one embodiment of the invention and illustrating portions thereof diagrammatically.

In accordance with the preferred forms of the invention illustrated in FIGS. 2 through 4, a sleeve 44, preferably a brass bushing, is fastened to the lower end of the push rod housing collar 36, the sleeve preferably having an annular recess 46 at the lower end thereof for receiving a conventional seal 48. Alternatively, the lower end of the push rod housing or collar may contain the seal 48 and the other structural elements hereinafter described, and the term "sleeve" is intended to include such other structure such as the push rod housing or collar. The seal, as illustrated, may comprise an elastomeric ring 50 having a groove at its upper surface for receiving an O-ring 52. The seal 48 per se is conventional and any other conventional seal having good sealing capabilities in conjunction with a reciprocating shaft such as the push rod may be utilized. The seal 48 may utilize a spring, or different shaped rings within the groove, these being other conventional off-the-shelf oil seals. Above the seal 48 extending substantially radially, and preferably 180° apart, are a pair of bores or passageways 54, 56 respectively, the bores opening adjacent the push rod 16 in an enlarged groove 58 which extends about the inner periphery of the sleeve 44 and acts to accumulate oil above the seal 48.

In the form of the invention illustrated in FIG. 2, a respective fitting 60, 62 is fastened to the sleeve in communication with the respective bore 54, 56. Fastened in flow communication to one of the fittings, to wit, fitting 62, is one end of a conduit 64 which is connected to a source of pressurized air indicated by compressor 66. Another conduit 68 is fastened at one end to the other fitting 60, the conduit 68 being returned to the end housing 40 or the interior of the head of the tufting machine. Consequently, lubricant which drips down in the push rod housing collar 36 between the push rod 16 and a bushing 70 accumulates in the enlarged area of the groove 58 and is carried by the pressurized air entering the bore 56 out through the bore 54 and to the oil sump within the end housing 40 of the tufting machine. With this arrangement only small amounts of lubricant drip onto the seal 48 thereby reducing substantially the amount of lubricant that may leak past the seal 48 onto the fabric being produced.

It has been found that with the construction just described some of the oil in the accumulator groove 58 tends to be blown back up the push rod thereby reducing the amount of lubrication that the push rod is receiving. Thus, an additional seal 72 which may be similar to seal 48 is interposed in another recess 74 formed in the sleeve 38 above the accumulator groove 58. With this construction the accumulator groove is isolated between the seals 48 and 72 so that no oil tends to flow upwardly along the push rod 16. Moreover, it has been found that with this construction additional oil may be supplied to the push rod without resulting in additional leakage from the system since any oil that leaks past the seal 72 enters the accumulator groove 58 and is removed by the air which carries it back to the tufting machine head.

It has been found that leakage from the push rod housing may be reduced by utilizing the same construction as illustrated in FIG. 2 but by sucking the lubricant from the accumulator groove 58 utilizing the oil pump 38 of the tufting machine or another oil pump. Thus, as illustrated in FIG. 3 conduits 158 and 162 may be interconnected by a Tee coupling 164 to a conduit 166 which communicates with an oil manifold 168, the manifold collecting oil from a number of conduits such as 170, 172, 174 each bring oil from a respective push rod. With this construction a substantial amount of oil is removed from the respective push rod housing by means of the vacuum created by the oil pump 38, the oil in the manifold 168 being returned through a conduit 176 to the inlet 178 of the pump 38.

A modification of the construction illustrated in FIG. 3 is indicated in FIG. 4 wherein the fitting 62 is removed from the bore 56 and the pump sucks oil only from the bore 54. It has been found that this construction provides slightly better results than the construction illustrated in FIG. 3, and by utilizing a needle valve 200 to control the amount of air sucked in through the bore 56 the system may be trimmed to substantially reduce leakage.

Figure 5:
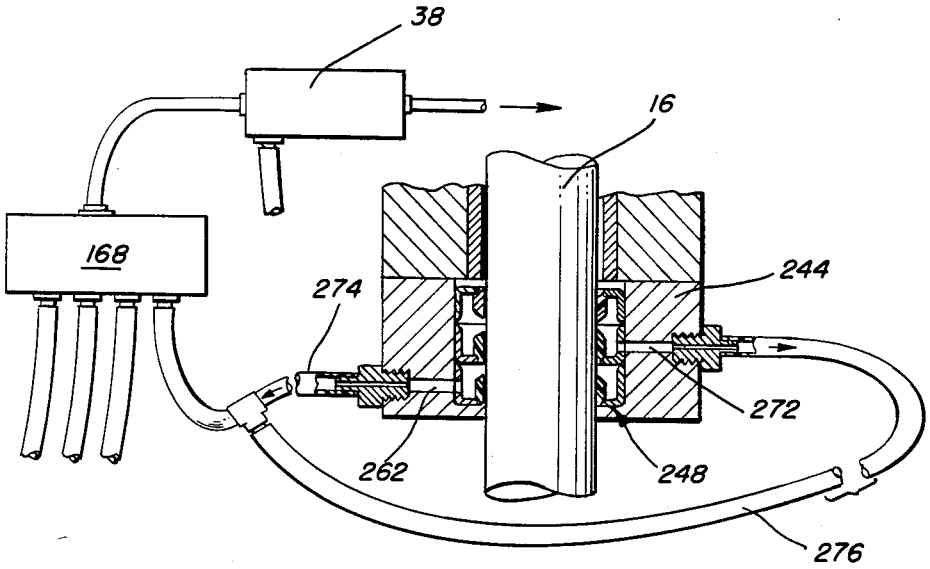
FIG. 5 is a view similar to FIG. 3, but illustrating the preferred form of the invention.
Figure 6:
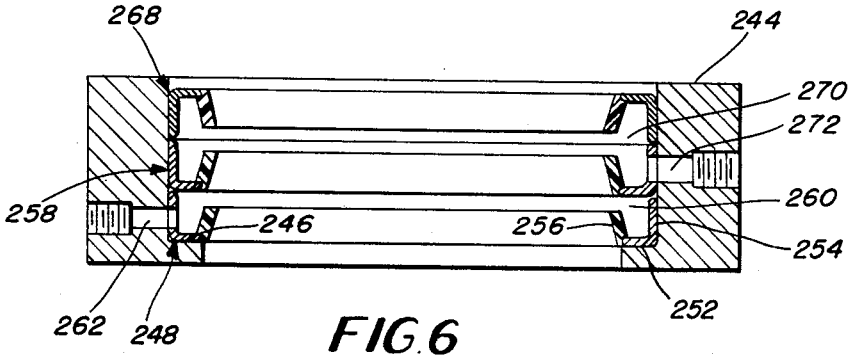
FIG. 6 is an enlarged view of the sleeve of FIG. 5 including the seals.

It should be understood that of the three embodiments heretofore illustrated, the results provided by utilizing air to forcibly remove the oil from the accumulator groove provides the best results. However, by far the best results were obtained with the embodiment illustrated in FIGS. 5 and 6, wherein a hollow sleeve 244 has a shelf 246 about the lower inner periphery. Disposed on the shelf 246 is a seal 248 which comprises a substantially rigid base in the form of an annular ring 252 having an upstanding leg 254, the ring 252 being disposed on the shelf 246 with the leg 254 securely disposed in sealing abutment with the inner wall of the sleeve 244. At the inner periphery of the ring 252 is secured a resillient sealing member 256. The seal 248 is conventional and is of the non-spring loaded grease retention/dirt exclusion type seal sold by Chicago Rawhide Manufacturing Company of Elgin, Ill. under type HM-14. This seal has a Nitrile synthetic rubber-like material as the member 256 bonded to a metallic ring 252.

A second seal 258 similar to seal 248 is disposed above the seal 248, the rigid ring of the seal 258 being disposed on the leg 254 of the seal 248 so as to form a lubricant accumulator 260 between the seals 248, 258. A passageway 262 extends through the sleeve 244 and opens into the accumulator 260.

A third seal 268 also similar to the seal 248 is disposed upon the seal 258 to form a second accumulator 270 therebetween and another passageway 272 opens into this accumulator. However, in this case it has been found that when the upper seal 268 is inverted relative to the seal 248 and 258 the results are astounding. When the passageways 262 and 272 are connected by conduits 274 and 276 respectively to the manifold 168 and the pump 138 as in the other embodiments, there is virtually no leakage from the push rod housing or seals. The majority of the oil that escapes from the push rod housing is removed from the upper accumulator 270 and what little oil is not so removed enters the accumulator 260 and is removed therefrom. Consequently, even with tufting machines operating at extremely high speeds, it has been found that leakage is no longer a problem.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a head, a plurality of push rods journally mounted in respective push rod housings depending downwardly from the head, drive means in the head reciprocably driving said push rods, and lubrication means including a lubricant supply for lubricating said drive means and said push rods, each of said push rod housings having a sleeve including an aperture extending therethrough for receiving a respective push rod, said sleeve including an annular recess, an annular seal disposed about said push rod within said recess, means defining a circumferential groove disposed in said sleeve above said seal opening onto said aperture and said push rod, first and second passageways communicating with said groove and extending through said sleeve for communicating said groove with the exterior of said sleeve, means communicating at least said first passageway with said lubrication means, and means for creating a pressure differential between said lubrication supply and said groove for returning lubricant accumulating in said groove to said lubricant supply.

2. In a tufting machine as recited in claim 1, wherein said means for creating a pressure differential comprises a source of high pressure air, and means communicating said source of high pressure air with said second passageway for blowing air into said groove and removing accumulated lubricant through said first passageway.

3. In a tufting machine as recited in claim 2, wherein said sleeve is fastened to and depends from said push rod housing.

4. In a tufting machine as recited in claim 3, wherein said sleeve includes a second annular recess disposed above said groove, and a second annular seal disposed about said push rod within said second recess, whereby said groove is isolated intermediate said seals.

5. In a tufting machine as recited in claim 1, wherein said means for creating a pressure differential comprises an oil pump having an inlet and an outlet, and means communicating said first passageway with the inlet of said pump.

6. In a tufting machine as recited in claim 5, including means communicating said second passageway with the inlet of said pump.

7. In a tufting machine as recited in claim 5, wherein said second passageway opens to ambient environment for drawing air through said second passageway.

8. In a tufting machine as recited in claim 7, including valve means in said second passageway to regulate the flow of air entering therein.

9. In a tufting machine as recited in claim 5, wherein said sleeve is fastened to and depends from said push rod housing.

10. In a tufting machine having a head, a plurality of push rods journally mounted in respective push rod housings depending downwardly from the head, drive means in the head reciprocably driving said push rods, and lubrication means including a lubricant supply for lubricating said drive means and said push rods, each of said push rod housings having a sleeve including an aperture extending therethrough for receiving a respective push rod, said sleeve including an annular opening, a plurality of annular seals disposed about said push rod within said opening, means defining an accumulator space disposed in said sleeve intermediate each adjacent pair of seals opening onto said aperture and said push rod, a passageway communicating each accumulator space with the lubrication means, and means for creating a pressure differential between said lubrication supply and each accumulator space for returning lubricant accumulating in each accumulator space to said lubricant supply.

11. In a tufting machine as recited in claim 10, wherein said sleeve is fastened to and depends from said push rod housing.

12. In a tufting machine as recited in claim 10, wherein said means for creating a pressure differential comprises an oil pump having an inlet and an outlet, and means communicating each passageway with the inlet of said pump.

13. In a tufting machine as recited in claim 10, wherein there are three seals stacked one above the other and defining two accumulator spaces.

14. In a tufting machine as recited in claim 13, wherein each seal includes a base and a resilient annular member fastened at its outer edge to said base and engaging the push rod at its inner edge, a first of the seals being inverted relative to the center seal and the third seal.

15. In a tufting machine as recited in claim 14, wherein said first seal is the uppermost seal.

16. In a tufting machine as recited in claim 15, wherein said sleeve is fastened to and depends from said push rod housing.

17. In a tufting machine as recited in claim 13, wherein each seal includes a base and a resilient annular member fastened at its outer edge to said base and engaging the respective push rod at the inner edge, each base comprising an outer wall extending substantially parallel to the push rod and a shelf extending toward said push rod, and wherein said resilient member is fastened to said shelf.

18. In a tufting machine as recited in claim 17, wherein the shelf of the center seal and the third seal extend from the lower end of the respective outer wall and the shelf of said first seal extends from the top end of its outer wall.

19. In a tufting machine as recited in claim 18, wherein said first seal is the uppermost seal.

20. In a tufting machine as recited in claim 19, wherein said sleeve is fastened to depends from said push rod housing.

21. In a tufting machine having a head, a plurality of push rods journally mounted in respective push rod housings depending downwardly from the head, drive means in the head reciprocably driving said push rods, and lubrication means supplied from a lubricant supply for lubricating said push rods, apparatus for substantially inhibiting leakage of oil from the push rod housings comprising, an annular seal disposed about a respective push rod, a lubricant accumulator disposed intermediate said seal and the head of the machine for collecting lubricant carried by said push rod before said lubricant reaches the seal, conduit means communicating said accumulator with said lubricant supply, and means for creating a pressure differential between said accumulator and said lubricant supply for returning collected lubricant from the accumulator through said conduit means to said lubricant supply.

22. In a tufting machine as recited in claim 21, wherein said accumulator comprises a sleeve disposed about said push rod and secured to said push rod housing, said sleeve having an annular recess for receiving said seal, said sleeve including a circumferential accumulator groove opening onto the push rod above said seal, said conduit means including a pair of passageways extending through said sleeve and opening onto said groove, and said conduit means communicates with each of said passageways.

23. In a tufting machine as recited in claim 21, wherein said means for creating a pressure differential comprises means for supplying air to one of said passageways, and said other passageway communicates with said supply.

24. In a tufting machine as recited in claim 23, wherein said sleeve includes a second annular recess, and a second annular seal disposed about said push rod within said second recess, said groove being disposed intermediate said seals.

25. In a tufting machine as recited in claim 22, wherein said means for creating a pressure differential comprises a pump for creating sub-atmospheric pressure at the inlet of one of said passageways.

26. In a tufting machine as recited in claim 25, including a valve disposed in the other passageway and opening said other passageway to ambient air.

27. In a tufting machine as recited in claim 22, wherein said means for creating a pressure differential comprises a pump for creating sub-atmospheric pressure at the inlet of both of said passageways.

28. In a tufting machine having a head, a plurality of push rods journally mounted in respective push rod housings depending downwardly from the head, drive means in the head reciprocably driving said push rods, and lubrication means supplied from a lubricant supply for lubricating said push rods, apparatus for substantially inhibiting leakage of oil from the push rod housings comprising, a plurality of annular seals disposed about each push rod, a lubricant accumulator disposed intermediate each adjacent pair of seals for collecting lubricant carried by a respective push rod before said lubricant reaches the seal furthest from the head, conduit means communicating each accumulator with said lubricant supply, and means for creating a pressure differential between each accumulator and said lubricant supply for returning collected lubricant from each accumulator through each conduit means to said lubricant supply.

29. In a tufting machine as recited in claim 28, wherein there are three seals stacked one above the other and defining two lubricant accumulators.

30. In a tufting machine as recited in claim 28, wherein said seals are disposed within a sleeve fastened to respective push rod housing.

31. In a tufting machine as recited in claim 29, wherein each seal includes a base and a resilient annular member fastened at its outer edge to said base and engaging the push rod at its inner edge, a first of the seals being inverted relative to the center seal and the third seal.

32. In a tufting machine as recited in claim 31, wherein said first seal is the uppermost seal.

33. In a tufting machine as recited in claim 32, wherein said seals are disposed within a sleeve fastened to respective push rod housings.

34. In a tufting machine as recited in claim 29, wherein each seal includes a base and a resilient annular member fastened at its outer edge to said base and engaging the respective push rod at the inner edge, each base comprising an outer wall extending substantially parallel to the push rod and a shelf extending toward said push rod, and wherein said resilient member is fastened to said shelf.

35. In a tufting machine as recited in claim 34, wherein the shelf of the center seal and the third seal extend from the lower end of the respective outer wall and the shelf of said first seal extends from the top end of its outer wall.

36. In a tufting machine as recited in claim 35, wherein said first seal is the uppermost seal.

37. In a tufting machine as recited in claim 36, wherein said seals are disposed within a sleeve fastened to respective push rod housing.

* * * * *